US007988154B1

(12) United States Patent
Regan, Jr.

(10) Patent No.: US 7,988,154 B1
(45) Date of Patent: Aug. 2, 2011

(54) AIR ACTUATED BALL GAME

(76) Inventor: James I. Regan, Jr., Turnersville, NJ (US)

( * ) Notice: Subject to any disclaimer, the term of this patent is extended or adjusted under 35 U.S.C. 154(b) by 0 days.

(21) Appl. No.: 12/661,128

(22) Filed: Mar. 11, 2010

(51) Int. Cl.
*A63F 7/00* (2006.01)

(52) U.S. Cl. ..... 273/348; 273/317; 273/400; 273/401; 273/402

(58) Field of Classification Search ..... 273/317, 273/348, 353, 398, 400–402, 108, 118 R, 273/118 A, 123 R, 123 A, 126 R, 126 A, 273/127 R, 127 B
See application file for complete search history.

(56) References Cited

U.S. PATENT DOCUMENTS 972,597 A * 10/1910 Byl ..... 273/126 R
1,433,437 A * 10/1922 Wakeham ..... 273/400
3,136,548 A * 6/1964 Engle ..... 273/123 R
3,784,200 A * 1/1974 Hotchkiss ..... 273/409
3,920,245 A * 11/1975 Gothreaux et al. ..... 473/470
3,960,378 A * 6/1976 Bahr ..... 273/317.3
4,014,543 A * 3/1977 Arad ..... 273/108.53
4,173,341 A * 11/1979 Olliges ..... 273/126 A
4,986,549 A * 1/1991 Kuhtic et al. ..... 273/402
5,516,114 A * 5/1996 Michlin et al. ..... 273/400
6,299,164 B1 * 10/2001 Yi ..... 273/126 A

* cited by examiner

*Primary Examiner* — Raleigh W. Chiu
(74) *Attorney, Agent, or Firm* — Stuart M. Goldstein

(57) ABSTRACT

An air actuated ball game which utilizes a table-like member having an exterior frame supporting a circular top surface. The top surface has a plurality of holes therethrough and is divided into equal segments each having a different color. Air from a fan or similar air generating means is compelled through the holes for moving sets of balls, each set of balls having a different color, around the top surface of the table-like member. Each of the sets of balls has a color which matches one of the segments. As balls move around the top surface, players must retrieve certain balls which drop into openings in each segment and bounce the balls into a cup located at the center of the top surface. Various rules of play are anticipated based on these basic game components.

21 Claims, 4 Drawing Sheets

AIR ACTUATED BALL GAME

BACKGROUND OF THE INVENTION

There are a number of games which utilize air to lift discs, pucks, balls and other moveable play elements over the surfaces of air tables. Most common in this regard are the various air hockey games, in which players attempt to aim a disc (puck) into openings (goals) at the opposite ends of the table.

While such games are fun to play, they have severe limitations in that generally only two individuals can play the game at one time. Also, air hockey and similar air actuated table games are played with a basic set of rules, the participants generally having a single objective, to score by directing the puck into the goal. As a result, the manner in which these games are played are subject to little variation and flexibility.

SUMMARY OF THE INVENTION

It is thus the object of the present invention to overcome the limitations of prior air actuated table games and to create a new, entertaining, and enjoyable game.

It is an object of the present invention to provide an air actuated table game which can be played by two to as many as eight or more participants.

It is another object of the present invention to provide an air actuated table game which is easy to learn and fun to play.

It is still another object of the present invention to provide an air actuated table game which can be played and enjoyed by children as well as adults.

It is a further object of the present invention to provide an air actuated table game which is portable and can be played anywhere where there is available electric power.

It is another object of the present invention to provide an air actuated table game which allows for flexibility in establishing the rules used in the game, thus permitting players to create different games using the same fundamental game components.

These and other objects are accomplished by the present invention, an air actuated ball game which utilizes a table-like member having an exterior frame supporting a circular top surface. The top surface has a plurality of holes therethrough and is divided into equal segments each having a different color. Air from a fan or similar air generating means is compelled through the holes for moving sets of balls, each set of balls having a different color, around the top surface of the table-like member. Each of the sets of balls has a color which matches one of the segments. As balls move around the top surface, players must retrieve certain balls which drop into openings in each segment and bounce the balls into a cup located at the center of the top surface. Various different rules of play are anticipated based on these basic game components.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
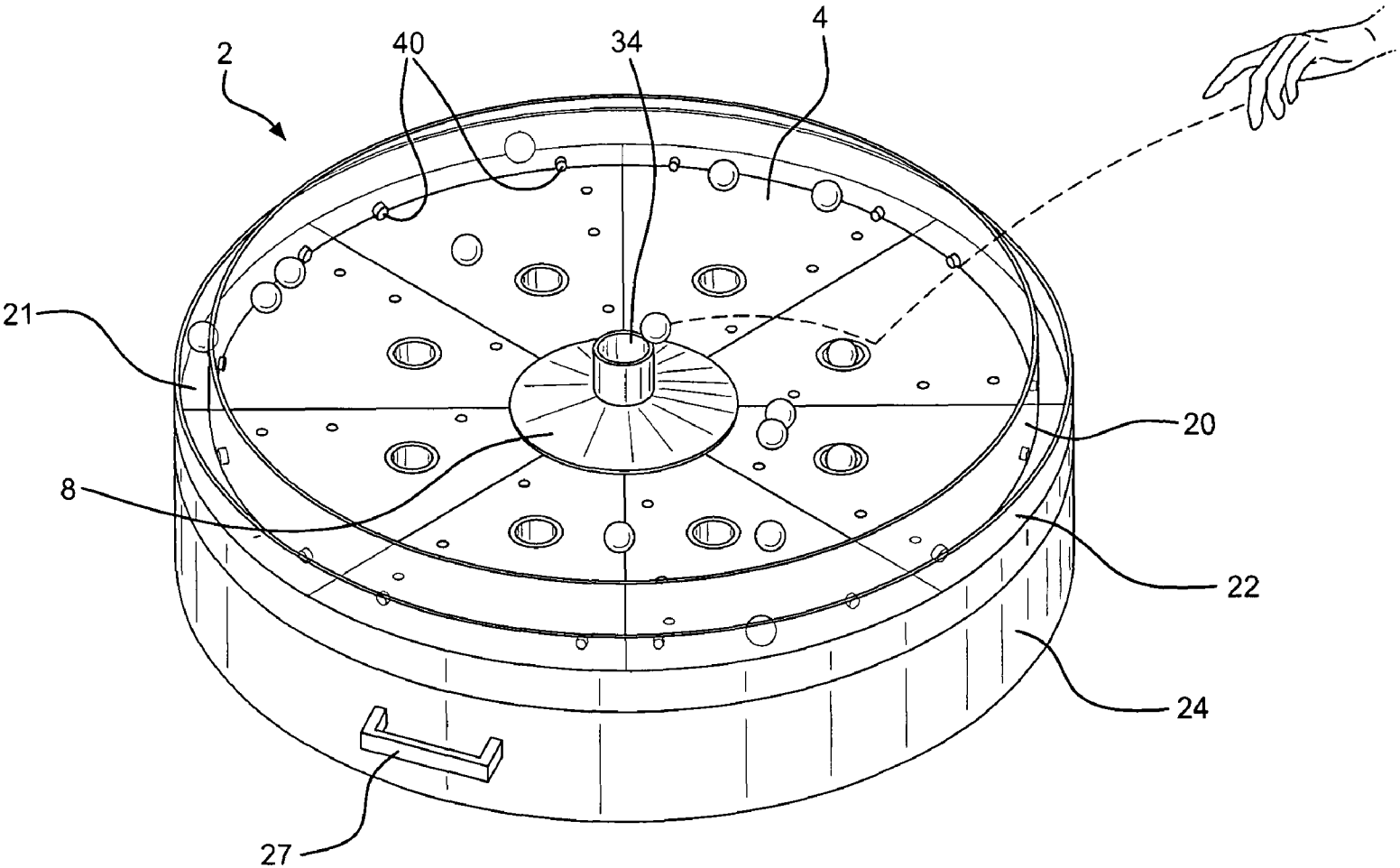
FIG. 1 is an isometric view of the game of the present invention.
Figure 2:
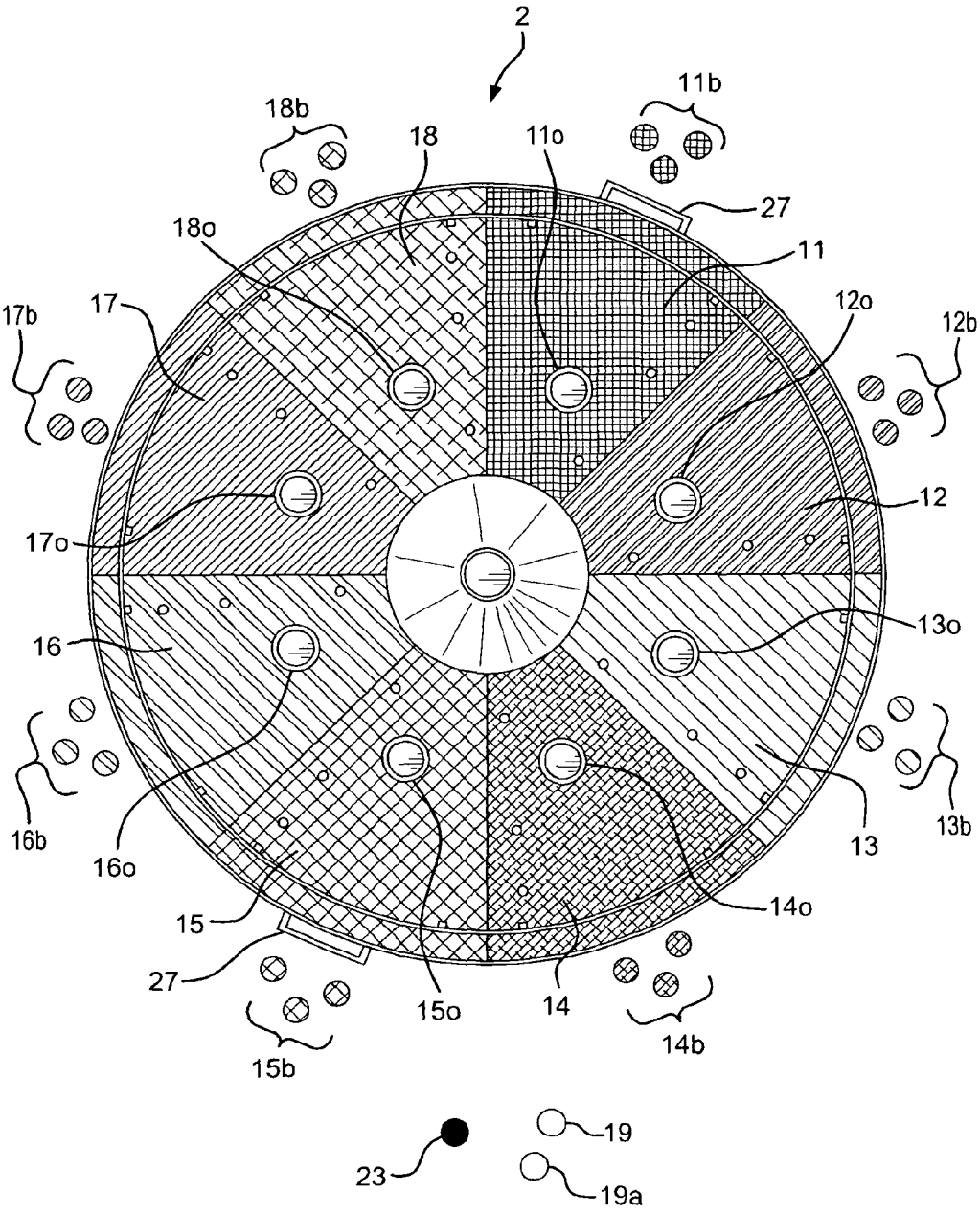
FIG. 2 is a top view of the table-like member of, with the balls used in, the game of the present invention.

The air actuated ball game of the present invention comprises table-like member 2, circular in configuration, having overlaying circular top surface 4. Top surface 4 is made of wood or similar material having a hard surface. It comprises a plurality of holes 6 therethrough. (See FIGS. 3 and 4). Center section 8 of table-like member 2 is slightly raised, with flat surface 10. Section 8 is tapered from flat surface 10 down to top surface 4.

Top surface 4 is divided into equal segments 11-18, each segment being a different color. Top surface 4 can be divided into fewer or greater segments, and the invention is not to be considered so restricted. Each segment comprises one center opening 11*o*-18*o* and three shallow surface indents, see for example, representative segment 11 having center opening 11*o* and surface indents 5, 7, and 9, shown in representative FIG. 3.

Border wall 20 extends upward from and completely around top surface 4 and rim 22 extends upward from and circumscribes the edge of top surface 4. Border wall 20 and rim 22 are made of rigid, transparent plexiglass or equivalent material. Space 21 is formed between border wall 20 and rim 22, around the full circumference of top surface 4.

Top surface 4 of table-like member 2 is supported by exterior frame 24 which encloses air plenum chamber 26 beneath the top surface. Electric motor operated fan 30 is supported within sub-plenum chamber 29 located in plenum chamber 26. Chamber 29 is surrounded by cylindrical walls 33. When fan 30 is turned on, it generates a flow of air from chamber 28, into upper chamber section 35, through holes 6, and over top surface 4. Handles 27 are provided for easy transport of table-like member 2.

Open cup 34 is configured to be placed on flat surface 10 of center section 8. Cup 34 is unattached and removeable from center section 8.

Sets consisting of three lightweight, ping-pong type player balls 11*b*-18*b* are provided to travel around top surface 4 of table member 2. Optimally, three identically colored player balls, the same color as one of segments 11-18, are provided for each player. For instance, set 11*b* of three red player balls—matching the red segment, e.g. segment 11, are provided for one player; set 12*b* of three blue player balls—matching the blue segment, e.g. segment 12, are provided for a second player, etc. In addition, two bonus gold balls 19 and 19*a* and one black ball 23 are used in the game.

The game commences upon each player placing his or her three colored player balls in each of the surface indents e.g. indents 5, 7, and 9, in the identically colored segment, e.g. segment 11. Matching color balls are placed on the indents of the colored segments which are not being played as well. After the three player balls of each player are positioned in the respective surface indents of the player's segment and the other balls are placed on the non-playing segments, cup 34 is removed from center section 8 and gold balls 19 and 19*a* and black ball 23 are put into the cup. Fan 30 is turned on, beginning the flow of air through holes 6 onto top surface 4. Gold balls 19 and 19*a* and black ball 23 are dropped from cup 34 onto top surface 4 and cup 34 is replaced on flat surface 10 of center section 8. Each player then places an ante, e.g. money, buttons, poker chips, etc. into cup 34.

Holes 6 extend through top surface 4 such that they generally direct airflow 31 from fan 30 in a clockwise direction and slightly towards center section 8. (See FIG. 3). Thus, in fabricating top surface 4, many of the holes are cut angled to the left, while others are cut so they are angled towards center section 8. This results in all balls, including, gold balls 19 and 19*a* and black ball 23, generally being compelled clockwise around and over top surface 4.

As gold balls 19 and 19*a* and black ball 23 are moved by the airflow around top surface 4, they knock player balls out of their initial positions within the surface indents, causing them to travel around the top surface as well. A plurality of stationary protrusions 40, which could be screws, bolts, or their equivalents, extend from border wall 20, above and adjacent to top surface 4. Balls circulating top surface 4 will, at some point, contact protrusions 40. Contact with protrusions 40, in combination with the air flow from holes 6, direct the balls toward the left. Thus protrusions 40 provide additional means to generally direct all the balls on top surface 4 in a clockwise, center-oriented direction.

Figure 3:
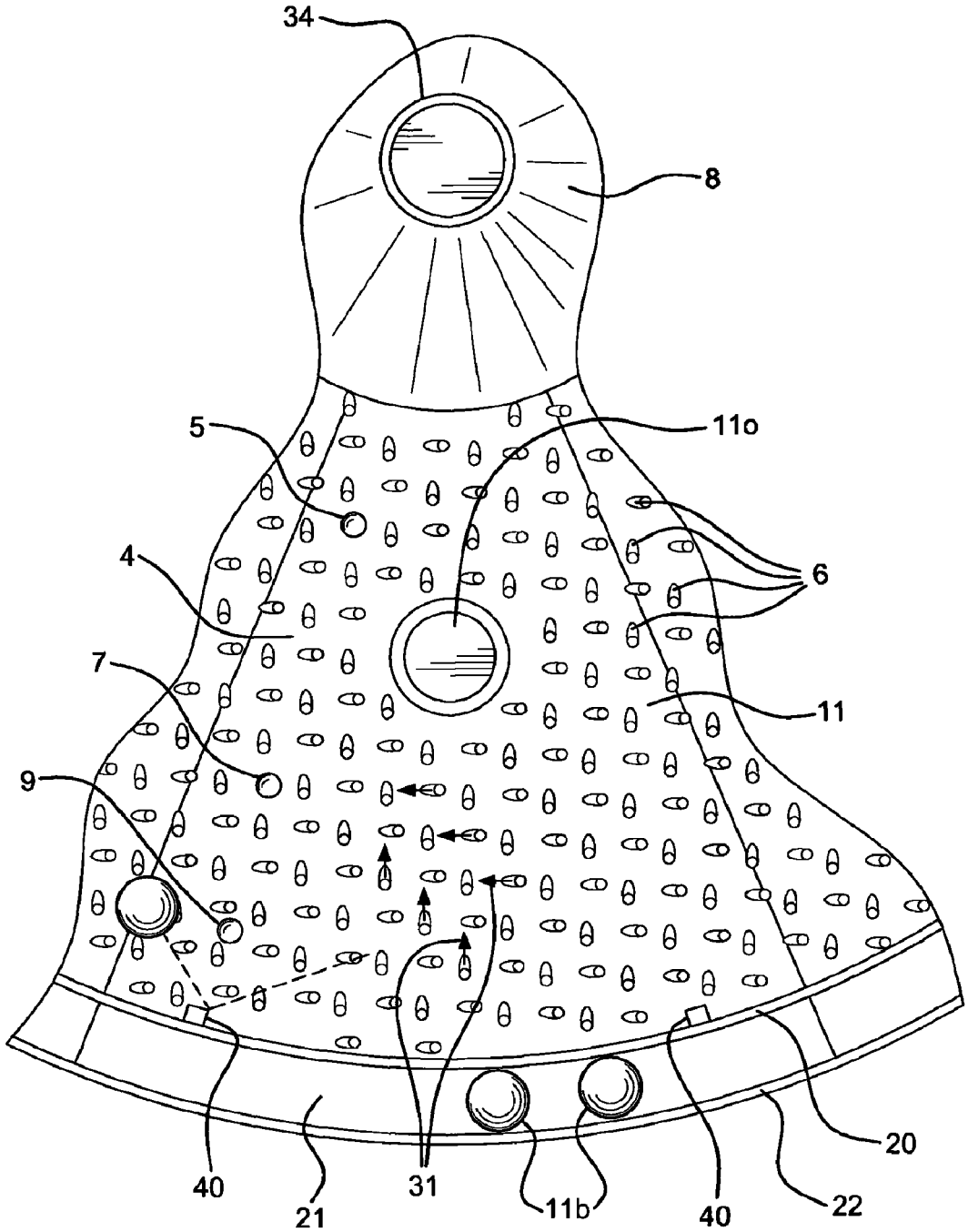
FIG. 3 is a close-up view of one segment of the top surface of the game of the present invention.
Figure 4:
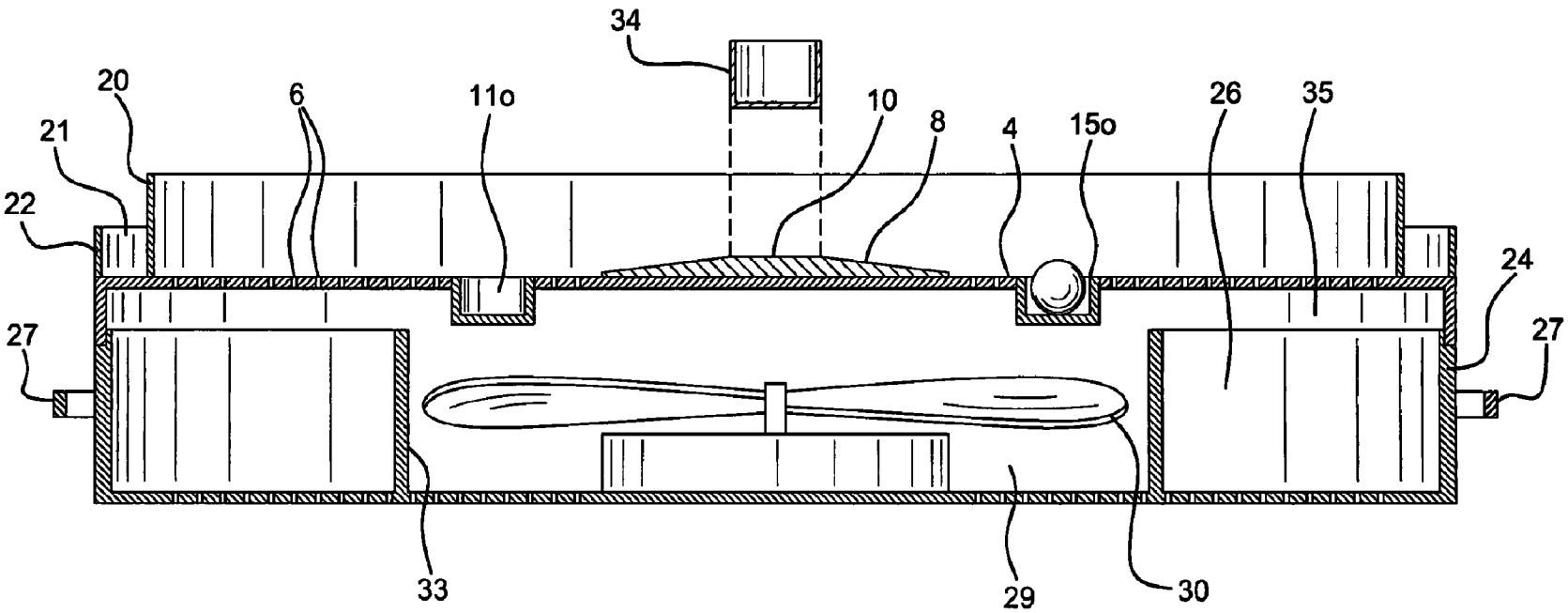
FIG. 4 is a cross-sectional side view of the game of the table-like member of the present invention.

As the balls travel around top surface 4, some will fall into center openings 11*o*-18*o* of segments 11-18. Surface indents, e.g. indents 5, 7, and 9 as shown in FIG. 3, are shallow enough in depth, such that once balls are knocked of the indents at the start of the game, no ball will again drop into them, even when a ball passes over the indents. When a player ball drops into a center opening in a segment having the same color as the ball, the game participant withdraws that ball and places it in space 21 between border wall 20 and rim 22. (See FIG. 3 and balls 11*b*). When the third of the player's balls drops into the center opening, the game participant playing this color must retrieve the ball, announce that he or she has "the last ball," and then bounce that ball onto top surface 4, into cup 34. (See FIG. 1). If the player is successful in doing so, he or she wins, thereby ending the game. After "last ball" is called, other players may attempt to block the ball which is being bounced toward cup 34 for the win. Any ball which drops into a player's segment after the "last call" announcement, can be used to block the bounced ball, including the gold and black balls. If "the last ball" fails to enter cup 34, it will again rejoin the other balls traveling around top surface 4 and play continues. The winning player receives whatever money, chips, etc. is contained in cup 34.

During the game, when a player ball drops into a center opening in a segment having a different color than the ball, the player of that colored segment removes the ball from the center opening and attempts to bounce it into cup 34. If successful, the player whose colored ball it is must add money, chips, etc. to cup 34. There is no penalty for failing to bounce another player's ball into cup 34. The game merely continues.

If a gold ball 19 or 19*a* drops into a center opening in a segment, the participant playing that segment removes the ball from the center opening and places it in space 21. However, if one player has possession of the gold ball and a second player subsequently acquires the second ball, the first player must return his or her gold ball to top surface 4. If a player ultimately is able to collect both gold balls 19 and 19*a*, he or she will collect half of the contents of cup 34 at the end of the game.

If black ball 23 drops into a center opening in a segment, the participant of that segment removes the ball from the center opening and attempts to bounce it into cup 34. If the player is successful, black ball 23 is removed from cup 34 and returned to top surface 4. If the player is unsuccessful, that player must add money, chips, etc. to cup 34.

When playing with chips, each player will be provided with an equal number of chips. When one player runs out of chips, the game still continues until there is a winner. A player is not penalized for not having sufficient chips to pay cup 34. At this point in the game, there is a "bounce-off".

The player with the most chips gets his or her three balls back. The player or players with no chips each get one ball and the other player or players each get two balls. After fan 30 is turned on, players toss their balls onto top surface 4. When an opponent's ball drops into the hole in the player's segment, he or she must bounce that ball into cup 34. A player's own ball which drops into the hole in that player's segment is returned to top surface 4. The object is to bounce all the balls of the opponents into cup 34. The player whose ball is the last one on top surface 4 is the winner.

While a specific set of rules of play of the air actuated ball game of the present invention are described above, it is anticipated that the game can be played in any manner, employing different rules, based on players' predilections and preferences. As such, the present invention should not be deemed restricted to the manner of play described or the rules of any given game.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An air actuated ball game comprising:

at least two sets of balls, each set having a different color;

a table-like member comprising an exterior frame supporting a circular top surface having a plurality of air holes therethrough, the top surface being divided into equally sized segments, and air generating means for compelling airflow through the holes for moving the sets of balls around the top surface; and container means located on the top surface for receiving balls retrieved from the top surface.

2. The air actuated ball game as in claim 1 further comprising means to direct the balls substantially in one circular direction around the top surface.

3. The air actuated ball game as in claim 1 further comprising a border wall extending upwards from and around the top surface.

4. The air actuated ball game as in claim 3 further comprising means to direct balls substantially in one circular direction around the top surface.

5. The air actuated ball game as in claim 4 wherein the means to direct the balls comprises stationary protrusions extending from the border wall.

6. The air actuated ball game as in claim 3 further comprising a rim circumscribing the edge of the top surface and forming a space between the rim and the wall border for the collection of balls.

7. The air actuated ball game as in claim 1 wherein the air holes are configured to direct airflow for moving the sets of balls substantially in one direction around the top surface.

8. The air actuated ball game as in claim 1 wherein the container means comprises a cup placed in the center of the top surface.

9. The air actuated ball game as in claim 1 wherein the exterior frame encompasses a plenum chamber located under the top surface, the air generating means being located within the plenum chamber.

10. The air actuated ball game as in claim 1 further comprising opening means in each segment for receiving balls being moved around the top surface.

11. The air actuated ball game as in claim 1 further comprising surface indents in each segment for maintaining one set of balls within the segment, prior to the start of the game.

12. The air actuated ball game as in claim 1 further comprising one additional ball of a color different than any of the balls in said sets of balls and two bonus balls having a different color than the additional ball or either any of the balls in said sets of the balls.

13. The air actuated ball game as in claim 12 wherein each of the individual balls in the sets of balls, the additional ball, and the bonus ball are configured to be bounced on the top surface and received in the container means.

14. The air actuated ball game as in claim 1 wherein each of the balls in the sets of balls are configured to be bounced on the top surface and received in the container means.

15. An air actuated ball game comprising:

at least two sets of balls, each set having a different color;

a table-like member comprising:

a top surface having a plurality of holes therethrough, the top surface being divided into equally sized segments, each segment having surface indents for maintaining one set of balls within the segment, prior to the start of the game, and opening means for receiving balls which are moved around the top surface;

a border wall extending upwards from and around the top surface;

means above and adjacent to the top surface to direct balls in substantially one circular direction around the top surface;

an exterior frame supporting the top surface and encompassing a plenum chamber;

air generating means located within the plenum for compelling airflow through the holes for moving the sets of balls around the top surface; and container means located on the top surface for receiving balls retrieved from the top surface.

16. The air actuated ball game as in claim 15 wherein the container means comprises a cup placed in the center of the top surface.

17. The air actuated ball game as in claim 16 further comprising a rim circumscribing the edge of the top surface and forming a space between the rim and the wall border for the collection of balls.

18. The air actuated ball game as in claim 15 wherein the means to direct the balls comprises stationary protrusions extending from the border wall.

19. The air actuated ball game as in claim 15 wherein the air holes are configured to direct airflow for moving the sets of balls in substantially one direction around the top surface.

20. The air actuated ball game as in claim 15 further comprising one additional ball of a color different than any of the balls in said sets of balls and two bonus balls having a different color than the additional ball or either any of the balls in said sets of the balls.

21. The air actuated ball game as in claim 20 wherein each of the individual balls in the sets of balls, the additional ball, and the bonus ball are configured to be bounced on the top surface and received in the container means.

* * * * *